US005417519A

United States Patent [19]

Smuts

[11] Patent Number: 5,417,519

[45] Date of Patent: May 23, 1995

[54] FORMWORK APPARATUS

[76] Inventor: Michiel Smuts, 554 Harrop Allin Avenue, Die Wilgers Pretoria, Transvaal, South Africa

[21] Appl. No.: 102,556

[22] Filed: Aug. 5, 1993

[30] Foreign Application Priority Data

Aug. 6, 1992 [ZA] South Africa ..... 92/5900

[51] Int. Cl.[6] ..... E02D 1/00

[52] U.S. Cl. ..... 405/133; 249/152; 249/180; 405/150.1

[58] Field of Search ..... 405/133, 132, 150.1; 249/152, 178, 180

[56] References Cited

U.S. PATENT DOCUMENTS

| | | | |
|---|---|---|---|
| 825,052 | 7/1906 | Henry et al. | 249/180 |
| 846,108 | 3/1907 | Jackson | 405/133 |
| 1,020,005 | 3/1912 | Witthoefft | 249/178 X |
| 1,061,491 | 5/1913 | Peck | 249/180 |
| 1,078,446 | 11/1913 | Lewis | 249/180 |
| 3,990,673 | 11/1976 | Jones et al. | 249/152 X |
| 5,066,165 | 11/1991 | Wofford et al. | 405/118 X |

FOREIGN PATENT DOCUMENTS

| | | |
|---|---|---|
| 95181 | 6/1970 | France . |
| 8800441 | 8/1988 | Germany . |
| 1075265 | 10/1964 | United Kingdom . |

*Primary Examiner*—Dennis L. Taylor

*Attorney, Agent, or Firm*—Scully, Scott, Murphy & Presser

[57] ABSTRACT

The formwork assembly (10) is used to cast tubular or part-tubular structures, one particular application being in the lining of mine ore passes with a concrete lining (54). The assembly includes an internal framework (12, 14, 32; 100, 102, 104) and external, flexible formwork (34, 130) supported by the framework. The framework can be adjusted between a casting condition (FIG. 1) in which it supports the formwork (34, 130) at the inner periphery of the structure which is to be cast and an inwardly collapsed condition in which it supports the formwork (34, 130) at a position spaced inwardly from such inner periphery. In the case of a mine ore pass lining, the assembly is moved upwardly in increments after each casting operation.

12 Claims, 4 Drawing Sheets

46
36
42
42
44
48
38
2
2
14
18
24
14
40
40
10
20
α
28
22
12
32
16
16
32
34
26
34
30
β

FORMWORK APPARATUS

BACKGROUND TO THE INVENTION

THIS invention relates to a formwork apparatus.

In some underground mines, such as diamond and gold mines, ore passes are sunk from one level to another. Rock which has been mined at higher levels of the mine is dropped from one level to the next through the system of ore passes. At a low level in the mine, the ore is collected and possibly crushed before being transported to surface for further processing to recover the valuable mineral content thereof.

The rock which has been tipped into and falls down the ore pass subjects the sides of the ore pass to severe impacts and it is therefore common to line the sides of the ore pass, usually with concrete.

Conventionally, the concrete lining of an ore pass is constructed by assembling formwork, typically in a cylindrical shape, composed of rigidly interconnected shutters. The formwork is centrally supported a short distance from the bare, excavated walls of the ore pass. Wet concrete is poured between the shutters and the excavated walls and is allowed to set. After setting, the formwork assembly is disassembled and moved to a higher elevation for a repetition of the exercise.

It will be appreciated that the repetitive assembly and disassembly of the formwork is time-consuming and labour intensive.

SUMMARY OF THE INVENTION

A first aspect of the invention provides a formwork assembly for use in casting a tubular or part-tubular structure, the formwork assembly comprising an internal framework and external, flexible formwork supported by the framework, the framework being adjustable between a casting condition in which it supports the formwork at the inner periphery of the structure which is to be cast and an inwardly collapsed condition in which it supports the formwork at a position spaced inwardly from such inner periphery.

Typically, the assembly comprises a central support structure, a series of spokes each having one end connected to the central support structure and an opposite end connected to a support member, and a flexible membrane attached to and supported by the support members, the spokes being connected to the central support structure and to the support members in pivotal fashion so as to be movable between an extended orientation in which the support members support the membrane at a casting position and a collapsed orientation in which the support members support the membrane at a position spaced inwardly from the casting position.

In one version, the central support structure is in the form of a column and the spokes are pivotally connected to the column is such a manner that initial pivotal movement of the spokes away from the casting orientation towards the collapsed orientation is such as to cause one end of the membrane to move inwardly prior to inward movement of the other end of the membrane.

This situation can be achieved in a case where some of the spokes are connected at one end to a sleeve capable of limited sliding movement on the column. The framework can be suspended on ropes, a ring being attached to the ropes and the column being movable relative to the ring. A screw jack mechanism is supported by the ring and is connected to the column to support the column relative to the ring, the screw jack mechanism being operable to raise the lower the column relative to the ring, thereby causing the spokes to pivot between the respective extended and collapsed orientations.

In another version of the invention, the central support structure comprises spaced apart rings joined to one another by links, the rings and links surrounding a central space allowing access through the central support structure. In this version of the invention, double-acting hydraulic cylinders are pivotally connected to the links and to the support members, the cylinders being extendable and contractible to cause the spokes to pivot between their respective orientations.

In a preferred application, the assembly is used to provide formwork for the casting of a tubular lining a mine ore pass.

A second aspect of the invention provides a method of casting a tubular or part-tubular structure, the method comprising the steps of:

a) locating flexible tubular or part-tubular formwork at a casting position corresponding to the inner periphery of the structure which is to be cast;
b) placing settable material behind the formwork and allowing such material to set;
c) inwardly collapsing the formwork and moving it axially to a new position;
d) at the new position, outwardly expanding the formwork to locate it at a casting position; and
e) repeating steps b) to d) as often as necessary to cast a desired length of the structure.

In the preferred application, the invention provides a method of lining a mine ore pass with a cast concrete lining, the method comprising the steps of:

a) locating flexible, tubular formwork at a casting position corresponding to the inner periphery of the desired ore pass lining;
b) placing wet concrete behind the formwork and allowing the concrete to set to a predetermined level;
c) inwardly collapsing the formwork and moving it axially to a new position higher up the ore pass:
d) at the new position in the ore pass, outwardly expanding the formwork to locate it at the casting position; and
e) repeating steps b) to d) as often as necessary to line the ore pass with a concrete lining.

The formwork assembly summarised above is preferably used in carrying out the method.

BRIEF DESCRIPTION OF THE DRAWINGS

The invention will now be described in more detail, by way of example only, with reference to the accompanying drawings in which.

DESCRIPTION OF PREFERRED EMBODIMENTS

Figure 1:
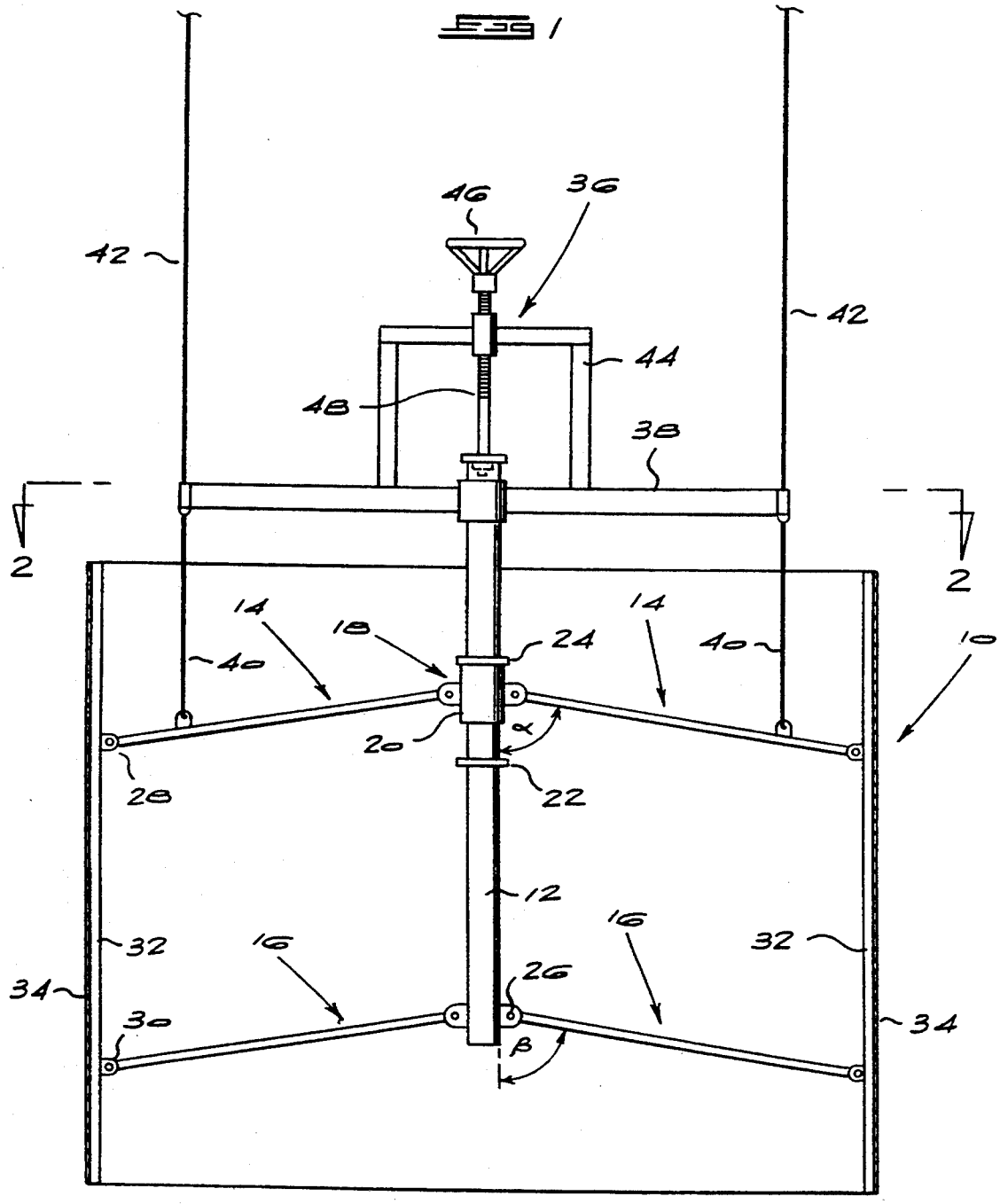
FIG. 1 illustrates, diagrammatically and partly in cross-section, a formwork assembly of the invention.
Figure 2:
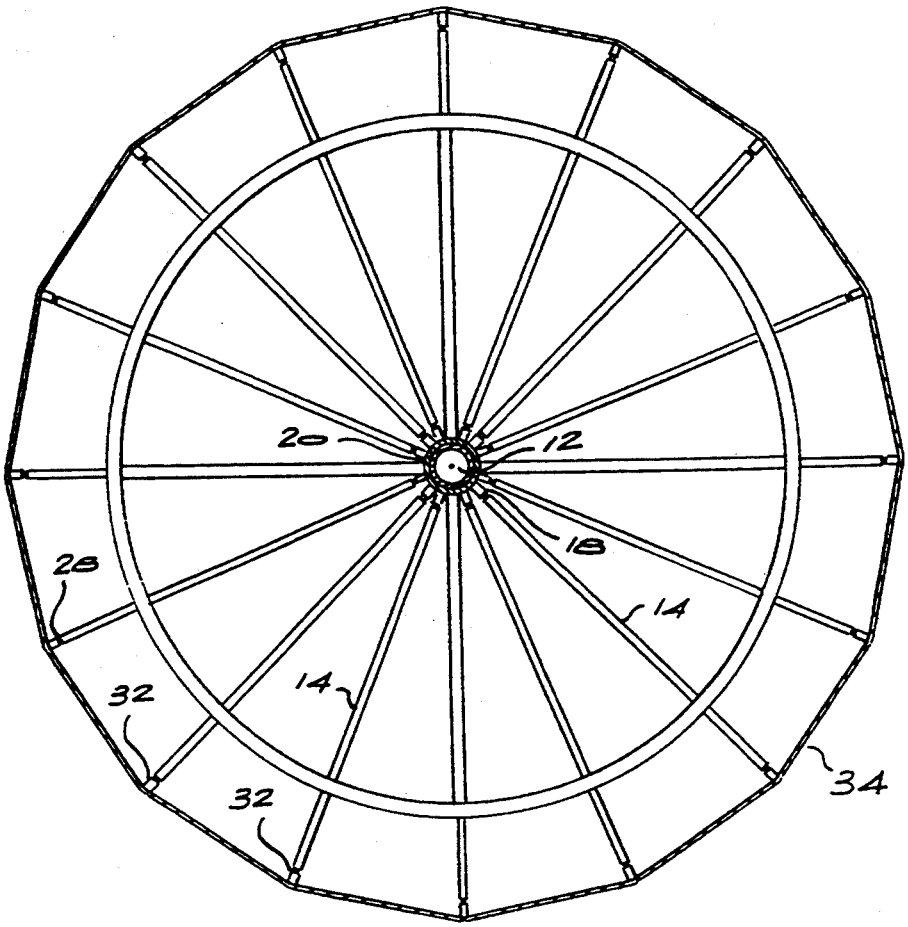
FIG. 2 shows a cross-section at the line 2—2 in FIG. 1.

With reference to FIGS. 1 and 2, a formwork assembly for use in the casting of a tubular structure, such as a concrete lining for an ore pass in a mine, is designated generally by the numeral 10.

The assembly 10 includes a central column 12. A series of upper spokes 14 are attached at one end, by means of hinges 18, to a sleeve 20 which is able to slide up and down the column 12 between fixed collars 22 and 24. A corresponding series of lower spokes 16 are attached by hinges 26 to the lower end of the column 12. The spokes 14 and 16 are able to pivot individually in angularly spaced planes containing the column axis.

The outer ends of the spokes 14 and 16 are attached by means of hinges 28 and 30 to upright supports 32 which are generally parallel to the column 12.

Referring to FIG. 2 in particular, it can be seen that the column 12, spokes 14 and 16 and supports 32 form a circular internal framework which is circumscribed by a tubular formwork membrane 34 of flexible material, in this case 45 mil (1,14 mm) thick HYPALON (trade mark of E I DuPont de Nemours & Co).

The membrane is secured to the supports 32 by any suitable means. For instance, the membrane may be clamped to the members 32 by flat bars riveted or otherwise secured to those members.

By pivoting the spokes 14 and 16 in upright planes relative to the column 12, the radial distance between the column 12 and the supports 32 is adjusted. Such adjustment varies the diameter and outer circumference of the circular internal framework. A reduction in the diameter of the framework causes the membrane 34 to be drawn inwardly towards the column 12, with the results that it folds or collapses in on itself in a festoon-like manner.

The radial expansion and contraction of the internal framework is achieved by means of a screw jack mechanism indicated generally with the numeral 36. The mechanism 36 is mounted on a support ring 38 which is suspended on ropes 42 from an overhead support structure (not shown) that includes a winch or other means for raising and lowering the formwork assembly. It will be noted that the upper spokes 14 are suspended by ropes 40 from the support ring 38. The ropes 40 also assist in maintaining the angular spacing of the spokes 14.

The mechanism 36 includes a jacking device having a frame 44 on the ring 38, a threaded aperture through the frame and a shaft 48 which extends in threaded fashion through the aperture and which is attached rotatably to the upper end of the column 12. A hand-wheel 46 is mounted fast on the upper end of the shaft 48.

Rotation of the hand-wheel 46 raises or lowers the shaft 48 and column 12 relative to the ring 38, depending on the direction of rotation. Axial raising or lowering of the column 12 has the effect of altering the angles $\alpha$ and $\beta$ defined between the column 12 and the spokes 14 and 16 respectively.

In general, upward movement of the column 12 decreases the angles $\alpha$ and $\beta$, while downward movement increases them.

Figure 3:
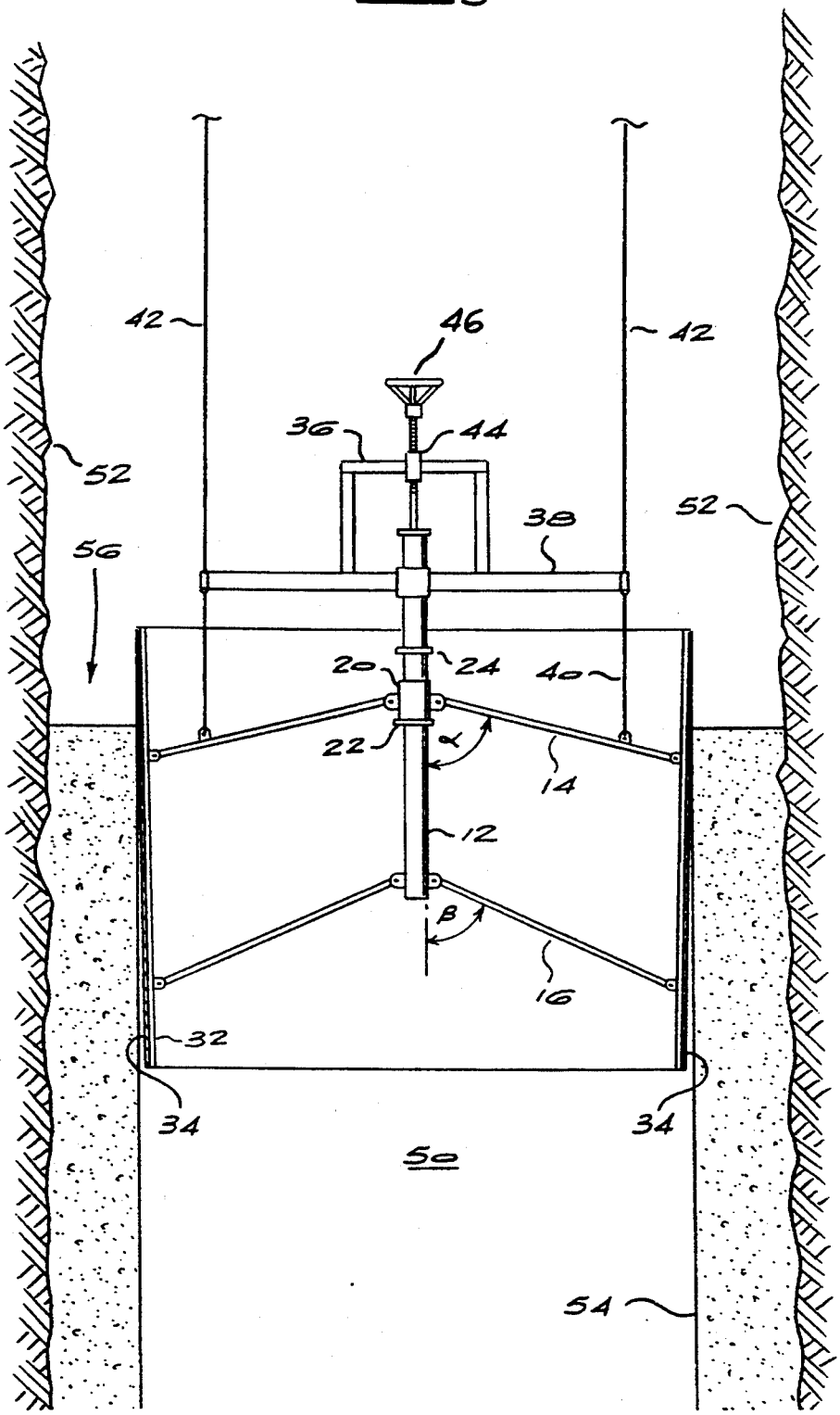
FIG. 3 illustrates the use of the formwork assembly of FIGS. 1 and 2 in the lining of an ore pass in a mine.

FIG. 3 illustrates the use of the apparatus described above in the casting of a concrete lining in an ore pass 50 excavated in a mine. The generally cylindrical wall of the ore pass is designated with the numeral 52 and a previous section of concrete lining with the numeral 54. The formwork assembly 10, suspended in the ore pass 50 by means of the ropes 42, is shown in the process of being relocated to a higher, as yet unlined section of the ore pass.

In FIG. 3, the internal framework is shown in a partially collapsed condition. This is achieved by rotating the hand-wheel 46 in a sense to raise the column 12 relative to the ring 38.

When the hand-wheel 46 is first rotated in this sense, the angle $\beta$ is immediately decreased. However, lost motion between the sleeve 20 and the column 12 allows the angle $\alpha$ to remain constant until such time as the collar 22 abuts the lower end of the sleeve and lifts it up.

In the result, the lower ends of the supports 32, and accordingly the lower end of the membrane 34, are pulled away from the previously cast lining section 54 before the upper ends thereof. Withdrawing the membrane 34 from the set concrete in this way helps overcome vacuum effects which may exist between the membrane and the cast concrete.

Once the membrane 34 has been withdrawn inwardly to a collapsed position clear of the previously cast concrete, the whole formwork assembly 10 is raised by means of the ropes 42 and the aforementioned winches or the like. The assembly is raised to a position in which the lower end of the membrane overlaps the previously cast concrete by a suitable margin of, say, 30 cm.

The handwheel 46 is then rotated in the sense to lower the column 12. The angles $\alpha$ and $\beta$ are increased as the spokes 14 and 16 pivot upwardly relative to the column 12. Given the lost motion that takes place between the column 12 and the sleeve 20, it will be appreciated that the lower end of the membrane begins to move outwardly into position before the upper end of the membrane moves outwardly, the latter only occurring when the collar 24 abuts the upper end of the sleeve 20.

With the membrane expanded to the appropriate position, the lower end thereof forms a seal against the upper end of the previously cast section of lining. Wet concrete can then be poured into the space 56 that is defined between the upper region of the membrane 34 and the wall 52 of the ore pass.

The assembly 10 is left in this position for a period of time sufficient for the newly poured concrete to set to a self-supporting state, whereafter the assembly 10 is collapsed, raised and expanded again for the casting of the next higher section of the ore pass lining.

Referring to FIG. 2, it will be appreciated that the static pressure of the wet concrete acting on the membrane 34 will cause it to bow inwardly between the supports 32. The resultant, non-circular inner surface of the ore pass lining will, it is believed, assist in preventing rock hang-ups in the ore pass—this being a common problem in smooth walled ore passes.

It will be appreciated that the column 12 and spokes 14 and 16 form a series of linkages which act in the manner of parallelogram linkages, with the exception that one corner in each such linkage has the facility both for pivotal and sliding movement, giving rise to the ability of the supports 32 to have orientations which are non-parallel to the column 12.

Many variations are possible within the scope of the invention. For instance, instead of the illustrated, manually operated mechanism 36, hydraulic, pneumatic, electrical or other means can be employed.

Figure 4:
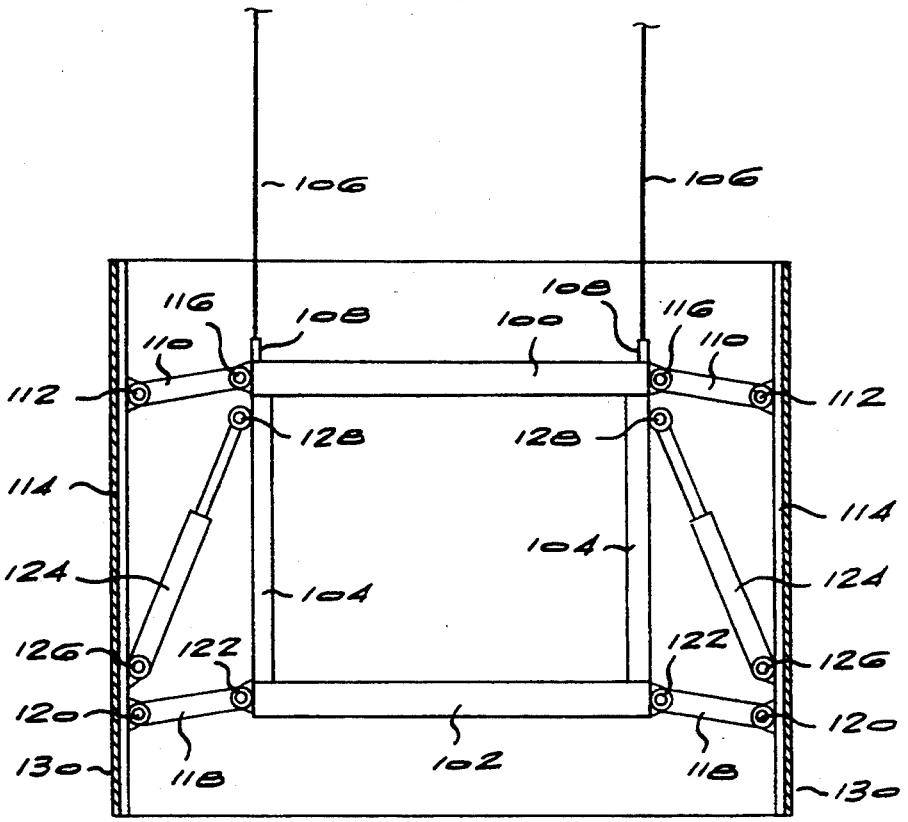
FIG. 4 illustrates, diagrammatically and partly in cross-section, a second version of formwork of the invention.
Figure 5:
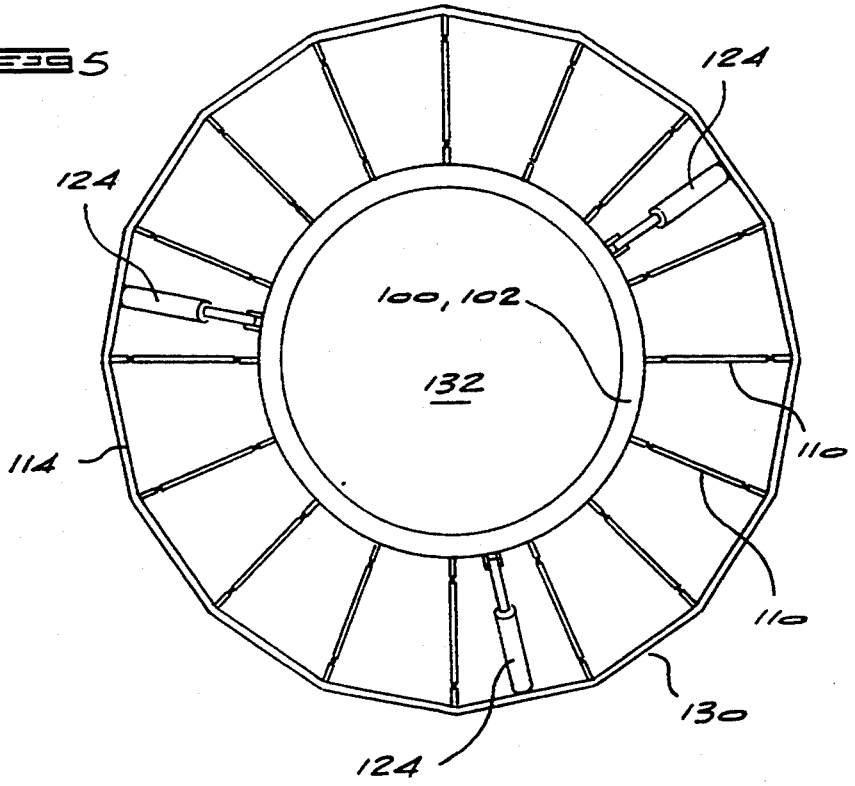
FIG. 5 shows a cross-section at the line 5—5 in FIG. 4.

FIGS. 4 and 5 illustrate a hydraulically actuated formwork assembly of the invention. In this case, the central column is replaced by a central support structure consisting of upper and lower rings 100 and 102 and angularly spaced apart links 104 which are fixed at top and bottom to the upper and lower rings respectively. Although FIG. 4 only illustrates one diametrically opposed pair of links, it will be apparent that there are many such links, angularly spaced apart from one another and extending between the upper and lower rings.

Ropes 106 are connected to brackets 108 on the upper ring 100, the ropes extending upwardly to an overhead support structure (not shown) which includes the necessary winching apparatus for raising and lowering the apparatus. Once again, only two of the ropes are visible but there may in practice be many more ropes connected to the upper ring 100 at angularly spaced apart positions.

Upper spokes 110 are pivotally connected at 112 to upright members 114 and at 116 to the upper ring 100. In similar fashion, lower spokes 118 are pivotally connected at 120 to the members 114 and at 122 to the lower ring 102. At each angular position, the spokes, central support structure and members 114 define a series of parallelogram linkages.

Double acting hydraulic cylinders 124 are pivotally connected at points 126 to the members 114 and at points 128, adjacent the upper ring 100, to the links 104.

The upright members 114 correspond to the members 32 of the first embodiment. A flexible membrane 130 is fastened to, and circumscribes these members. In full lines, FIG. 4 shows the membrane in an expanded state with the spokes 110 and 118 virtually horizontal.

The membrane is moved from the illustrated expanded state to a collapsed state by extending the hydraulic cylinders. Conversely, the membrane is moved from the collapsed state by contracting the cylinders. The cylinders can be operatively linked to one another to act in unison.

One particular advantage of the embodiment of FIGS. 4 and 5 when compared to the first embodiment is the fact that the central support structure forms an open space 132 providing access from above the formwork apparatus to below it. Materials and men can pass up and down through the apparatus should this be necessary.

Also, while the assembly 10 has been described in relation to the casting of a generally round cylindrical lining, it will be appreciated that other cross-sectional shapes are also possible with appropriate design of the internal framework and membrane.

So, for instance, a formwork assembly of the invention can be used to line ore passes or other shafts having triangular, rectangular or other non-circular shapes.

The invention has been described specifically in relation to the lining of a completely tubular ore pass, which will normally be vertical or nearly so. It is however anticipated that the principles of the invention could be used in the lining of horizontal tunnels or passages. In some cases, the lining which is cast may be only partially tubular, for instance in situations where the side and hanging walls only of a mine roadway or tunnel are lined. In cases where lining proceeds laterally, the formwork assembly could be conveyed in the appropriate direction by means of a vehicle.

The method of the invention as summarised earlier in this specification could also be put into practice using formwork which is gas or liquid inflatable, typically in the form of a balloon.

The balloon can be inflated to provide support for wet concrete in tunnel or shaft lining applications, and then deflated for relocation. Preferably, in a gas inflation system, the gas will be denser than air, such as carbon dioxide.

Depending on the design and intended application, the balloon may require no internal expandable and contractible framework, with the internal inflation pressure being sufficient to render the surface of the balloon sufficiently rigid to support the wet lining material. Also, shape-forming batons or ribs may be incorporated in the membrane of which the balloon is made, in order to give the cast tubular or part-tubular structure a desired shape.

I claim:

1. A formwork assembly for use in casting a tubular or part-tubular structure, the formwork assembly comprising a flexible formwork membrane and an internal framework which includes a plurality of parallel support structures supporting the flexible formwork membrane, the internal framework being adjustable between an extended configuration in which the support members support the membrane in a tubular or part-tubular configuration at a casting position corresponding to the inner periphery of the structure which is to be cast and an inwardly collapsed configuration in which the support members are moved inwardly towards one another so that the membrane is supported at a position spaced inwardly from the casting position and so that the membrane assumes a folded configuration between the support members.

2. A formwork assembly according to claim 1 wherein the assembly comprises a central support structure, a series of spokes each having one end connected to the central support member and an opposite end connected to a support member, the spokes being connected to the central support member in pivotal fashion so as to be movable between said extended configuration in which the support members support the membrane at a casting position and said inwardly collapsed configuration.

3. A formwork assembly according to claim 2 wherein the central support structure is in the form of a column and the spokes are pivotally connected to the column is such a manner that initial pivotal movement of the spokes away from the casting configuration towards the collapsed configuration is such as to cause one end of the membrane to move inwardly prior to inward movement of the other end of the membrane.

4. A formwork assembly according to claim 3 wherein some of the spokes are connected at one end to a sleeve capable of limited sliding movement on the column.

5. A formwork assembly according to claim 3 wherein the framework is suspended on ropes, a ring is attached to the ropes, the column is movable relative to the ring and a screw jack mechanism is supported by the ring and is connected to the column to support the column relative to the ring, the screw jack mechanism being operable to raise the lower the column relative to the ring and thereby cause the spokes to pivot between the respective extended and collapsed configuration.

6. A formwork assembly according to claim 2 wherein the central support structure comprises spaced apart rings joined to one another by links, the rings and links surrounding a central space allowing access through the central support structure.

7. A formwork assembly according to claim 6 wherein double-acting hydraulic cylinders are pivoted connected to the links and to the support members, the cylinders being extendable and contractible to cause the spokes to pivot between their respective configurations.

8. A formwork assembly according to claim 1 when used to provide formwork for the casting of a tubular lining a mine ore pass.

9. A method of casting a tubular or part-tubular structure, the method comprising the steps of:

a) providing an internal framework which includes a plurality of spaced apart, parallel support members, the internal framework being adjustable between an extended configuration and an inwardly collapsed configuration;

b) supporting a flexible tubular or part-tubular formwork membrane on the support members;

c) adjusting the internal framework to its extended configuration so as to locate the membrane at a casting position corresponding to the inner periphery of the structure which is to be cast;

d) placing settable material behind the membrane and allowing such material to set;

e) adjusting the internal framework to its inwardly collapsed configuration so as to move the support members inwardly towards one another and thereby to cause the membrane to move inwardly away from the casting position and assume a folded configuration between the support members;

f) moving the framework and membrane axially to a new position; and g) repeating steps c) to f) to cast a desired length of the structure.

10. A method of lining a mine ore pass with a cast concrete lining, the method comprising the steps of:

a) providing a framework inside the ore pass, the framework including a plurality of spaced apart, parallel support members and being adjustable between an extended configuration and an inwardly collapsed configuration;

b) supporting a flexible tubular or part-tubular formwork membrane on the support members;

c) adjusting the framework to its extended configuration so as to locate the membrane at a casting position located inwardly of the wall of the ore pass and corresponding to the inner periphery of the lining which is to be cast;

d) placing settable material behind the membrane and allowing such material to set to form a portion of the length of the lining;

e) adjusting the framework to its inwardly collapsed configuration so as to more the support members inwardly towards one another and thereby to cause the membrane to move inwardly away from the casting position and assume a folded configuration between the support members;

f) moving the framework and membrane axially to a new position in the ore pass; and g) repeating steps c) to f) to cast a desired length of the lining.

11. A method according to claim 9 when carried out using a formwork assembly according to any one of claims 1 to 8.

12. A method according to claim 11 when carried out using a formwork assembly according to any one of claims 1 to 8.

* * * * *